US006374731B1

(12) United States Patent
Walczak et al.

(10) Patent No.: US 6,374,731 B1
(45) Date of Patent: Apr. 23, 2002

(54) LITHOGRAPHIC NEWSPAPER PRINTING PRESS

(75) Inventors: Peter W. Walczak, Dover; Charles Henry Dufour, Durham, both of NH (US); Michael Stevenson, Gouvieux (FR); John Sheridan Richards, Barrington; Roland Thomas Palmatier, Durham, both of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 249 days.

(21) Appl. No.: 08/844,350

(22) Filed: Apr. 18, 1997

(51) Int. Cl.[7] ..... B41F 7/12; B41F 13/10

(52) U.S. Cl. ..... 101/142; 101/216; 101/217; 101/375

(58) Field of Search ..... 101/136–138, 101/141, 142, 216, 217, 219–221, 229, 178–181, 183, 378, 415.1, 375

(56) References Cited

U.S. PATENT DOCUMENTS

| | | | | | |
|---|---|---|---|---|---|
| 3,230,879 | A | | 1/1966 | Worthington | 101/378 |
| 3,335,663 | A | | 8/1967 | Harenza | 101/415.1 |
| 3,774,536 | A | * | 11/1973 | Raymond et al. | 101/207 |
| 3,992,992 | A | * | 11/1976 | Smith | 101/148 |
| 4,281,597 | A | * | 8/1981 | Dressler | 101/365 |
| 4,458,591 | A | * | 7/1984 | Guaraldi | 101/218 |
| 4,538,517 | A | * | 9/1985 | Michalik et al. | 101/227 |
| 4,913,048 | A | * | 4/1990 | Tittgemeyer | 101/141 |
| 4,987,830 | A | * | 1/1991 | Fukuda et al. | 101/228 |
| 5,054,392 | A | * | 10/1991 | Greenwood | 101/169 |
| 5,152,222 | A | * | 10/1992 | Okamura et al. | 101/211 |
| 5,241,905 | A | * | 9/1993 | Guaraldi et al. | 101/375 |
| 5,277,112 | A | * | 1/1994 | Ohta et al. | 101/450.1 |
| 5,345,864 | A | * | 9/1994 | Machguth et al. | 101/216 |
| 5,429,048 | A | * | 7/1995 | Gaffney et al. | 101/217 |
| 5,454,311 | A | * | 10/1995 | Reffert | 101/216 |
| 5,481,971 | A | * | 1/1996 | Grutzmacher et al. | 101/183 |
| 5,528,987 | A | * | 6/1996 | Andersson et al. | 101/219 |
| 5,535,675 | A | * | 7/1996 | Gentle | 101/248 |
| 5,778,779 | A | * | 7/1998 | Jones et al. | 101/216 |

* cited by examiner

*Primary Examiner*—Stephen R. Funk
(74) *Attorney, Agent, or Firm*—Kenyon & Kenyon

(57) ABSTRACT

A lithographic newspaper printing press comprises printing units (4.1 to 4.5) which are mounted on top of each other, forming a tower arrangement (2). Each printing unit comprises a first and a second plate cylinder (24*a*, 24*b*) having a length being substantially four times the width of a newspaper page and having a circumference being substantially equal to the height of a newspaper page. Each printing unit 4 further comprises a first and a second blanket cylinder (10*a*, 10*b*) associated with said first and second plate cylinders (24*a*, 24*b*), whereby each of said first and second blanket cylinders (10*a*, 10*b*) has substantially the same diameter as the associated plate cylinder (24*a*, 24*b*). Each of the blanket cylinders (10*a*, 10*b*) carries a respective continuous sleeve-shaped printing blanket (12*a*, 12*b*) which is axially removable from the respective plate cylinder through an aperture formed in the side wall of the housing of the printing unit, while the respective blanket cylinder (10*a*, 10*b*) is cantilevered in the opposite side wall of the housing.

14 Claims, 4 Drawing Sheets

1
8
2d
2c
2b
2a
6
4.4
4.3
4.5
4.2
4.1

LITHOGRAPHIC NEWSPAPER PRINTING PRESS

FIELD OF THE INVENTION

The present invention relates to a lithographic newspaper printing press for printing four pages across the first and the second side of a running web at every revolution.

BACKGROUND OF THE INVENTION

Lithographic newspaper printing presses for printing four single or multiple colored newspaper pages across the first and the second side of a running web (16-page presses) are generally known in the art and are used for printing single or multicolored daily or free newspapers.

From the applicant's Galaxy-series presses, it is known to employ blanket-to-blanket printing units having plate cylinders, each carrying two printing plates around and four printing plates across (8×2-design), whereby each printing plate carries the image of a corresponding newspaper page to be printed.

Owing to the double-size blanket cylinders and the corresponding double-size plate cylinders carrying two printing plates around the circumference of each cylinder, such 8×2-design presses usually comprise a high weight and are comparatively large in size and, therefore, require an expensive reinforced bottom plate or foundation for supporting the printing units and an enlarged pressroom space.

Furthermore, the paging flexibility of 8×2-design presses is generally comparatively low, and the page-break—the number of pages that have to be printed without producing a blank page in the printed product—of such presses usually amounts to four pages.

U.S. Pat. No. 3,335,663 purports to disclose a plate lock-up mechanism mounted to a single-size plate cylinder, on which altogether four conventional printing plates are mounted across the width of the cylinder. Although in the document it is mentioned, that the disclosed cylinder is a reversible cylinder which can be used in a newspaper printing press, it does neither describe nor show any details about a printing press.

U.S. Pat. No. 3,230,879 describes a plate lock-up mechanism for a double-size plate cylinder carrying four stereotype printing plates across and two of those plates around the circumference. The document gives no information about the kind of printing presses the cylinder can be used for.

SUMMARY OF THE INVENTION

Having outlined the state of the art and its attendant disadvantages, it is an object of the present invention to provide a high-performance 8-page newspaper printing press for printing four newspaper pages across, which is small in size, light in weight and easily accessible, which can be operated with a small number of staff and which allows an easy and quick change of printing plates and printing blankets.

It is another object of the present invention, to provide a newspaper printing press in which the width of the unprinted margin of each printed newspaper page is reduced to only a fraction of the width of the minimum margin achievable with conventional prior art newspaper presses.

According to exemplary embodiments of the present invention, a lithographic newspaper printing press comprises a printing unit with a housing having a first side wall and a second side wall, a first and a second plate cylinder, each being rotatably mounted in said housing, said plate cylinders having a length being substantially four times the width of a newspaper page and having a circumference being substantially equal to the height of a newspaper page; a first and a second blanket cylinder associated with said first and second plate cylinders, each of said first and second blanket cylinders having substantial diameter as the associated plate cylinder, an axially removable continuous blanket sleeve mounted on each of said first and second blanket cylinders, whereby each of said first and second blanket cylinders are cantilevered in said first side wall of said housing, when said continuous blanket sleeves are removed from said first and second blanket cylinders.

According to a further embodiment of the present invention, the first and second plate cylinders and the associated blanket cylinders of each printing unit are arranged substantially in line.

Pursuant to another embodiment of the invention, each couple formed of a plate cylinder and its associated blanket cylinder in a printing unit is driven by a separate motor.

According to a preferred embodiment of the invention, each of the first and second plate cylinders is carrying four conventional flat printing plates which are wrapped around and held on the plate cylinders by a plate lock-up mechanism, whereby the printing plates are arranged on the plate cylinder side by side.

In an alternative embodiment, each of the first and second plate cylinders can carry four axially removable continuous printing plates, whereby the first and second plate cylinders are cantilevered in one sidewall of said housing, when the continuous printing plates are axially removed from the plate cylinder through a respective aperture formed in the other side wall of the housing. In this embodiment of the present invention, the continuous axially removable printing plates are preferably arranged on the respective plate cylinder side by side.

Alternatively, the conventional flat plates or the axially removable continuous plates can be arranged on the associated plate cylinder in predetermined distances from each other.

According to the preferred embodiment of the invention, the length of said first and second plate cylinders is in the range be en 1200 mm and 1700 mm, and the circumference of each of said first and second plate cylinders is in the range between 470 mm and 650 mm. The length to diameter ratio of said first and second plate cylinders is preferably in the range between 8.4:1 and 9:1.

According to an exemplary embodiment of the invention, four printing units, each printing unit printing a different color, are preferably arranged on top of each other, whereby the web is running substantially vertically from one unit to the other. Additionally, there can be a fifth printing unit arranged on top of the four printing units. In this embodiment, the four printing units are preferably for printing the colors yellow, magenta, cyan and black, and said fifth printing unit is used as an imprinting unit for printing spot-colors which are different from said colors of said four printing units.

Alternatively, the fifth printing unit is printing the same color as one of said four printing units and is operated in alternation with said printing unit printing the same color, so that the respective printing unit currently not in operation can be equipped with new blankets or with printing plates for the next print job, while the other printing units are in operation.

The printing press according to the present invention is eventually preferably used, together with a known pinless folding apparatus for processing the printed web into signatures, in order to minimize the margin of each signature and therewith the amount of paper needed for a specific print job.

The printing press according to the present invention has a number of advantages which will be described herein below.

Firstly, owing to the small diameter of the plate cylinder, the number of printing plates needed for each print job is only half the number needed for known 16-page-presses carrying two identical printing plates around the circumference and four printing plates across the width of the web. Thus, the costs and space needed for producing and storing the printing plates tremendously reduced. Furthermore, in a newspaper printing press according to the present invention, the number of page-breaks or page-jumps is reduced to two, so that the flexibility of paging is increased, as compared to 8-presses in which the number of page-breaks usually amounts to four. Accordingly, with a newspaper printing press according to the present invention, there is a much higher flexibility in arranging the set-up of each newspaper page, leading to a reduction of time and costs involved in pre-press. Besides, the amount of spoilage produced when a printing plate is wrongly mounted on the plate cylinder is also reduced, as compared to conventional 4×2-newspaper presses.

Secondly, the downtime of the press caused by the printed web wrapping around the blanket cylinder in case of a web break or a broken blanket is significantly reduced, since the continuous printing blanket with the web wrapped around can easily be axially removed through an aperture in the side wall and be replaced by a new blanket. Thus, there is no downtime needed for removing the compressed and hardened layer of web and ink from the blanket cylinder, as it is usually needed when using conventional printing blankets.

Furthermore, owing to the low height of the printing units and the tower arrangements comprised of four or five printing units disposed on top of each other, the so-called "fan out" of the web is comparatively small. Accordingly, the quality of the printed products is significantly improved. Besides, the reduced height of such tower arrangements requires only one gallery for a five-unit tower arrangement, leading to an increase of working economy and a reduction of material costs. For example, the make-ready operations for setting up the fifth printing unit of a five-unit tower arrangement, when running said fifth unit in alternation with one of the other four units of said tower arrangement, can easily be performed by one person standing on said gallery, without using a ladder or any other kind of objects to stand on. Thus, the operation of a press according to the present invention having a five-unit tower arrangement does not require additional safety precautions for preventing a pressman from falling down when setting up the upper printing unit.

BRIEF DESCRIPTION OF THE DRAWINGS

The present invention, together with additional objects and advantages thereof, will be best understood from the following description of specific exemplary embodiments, when read in connection with the accompanying drawings, in which.

Detailed Description of the Invention

Figure 1:
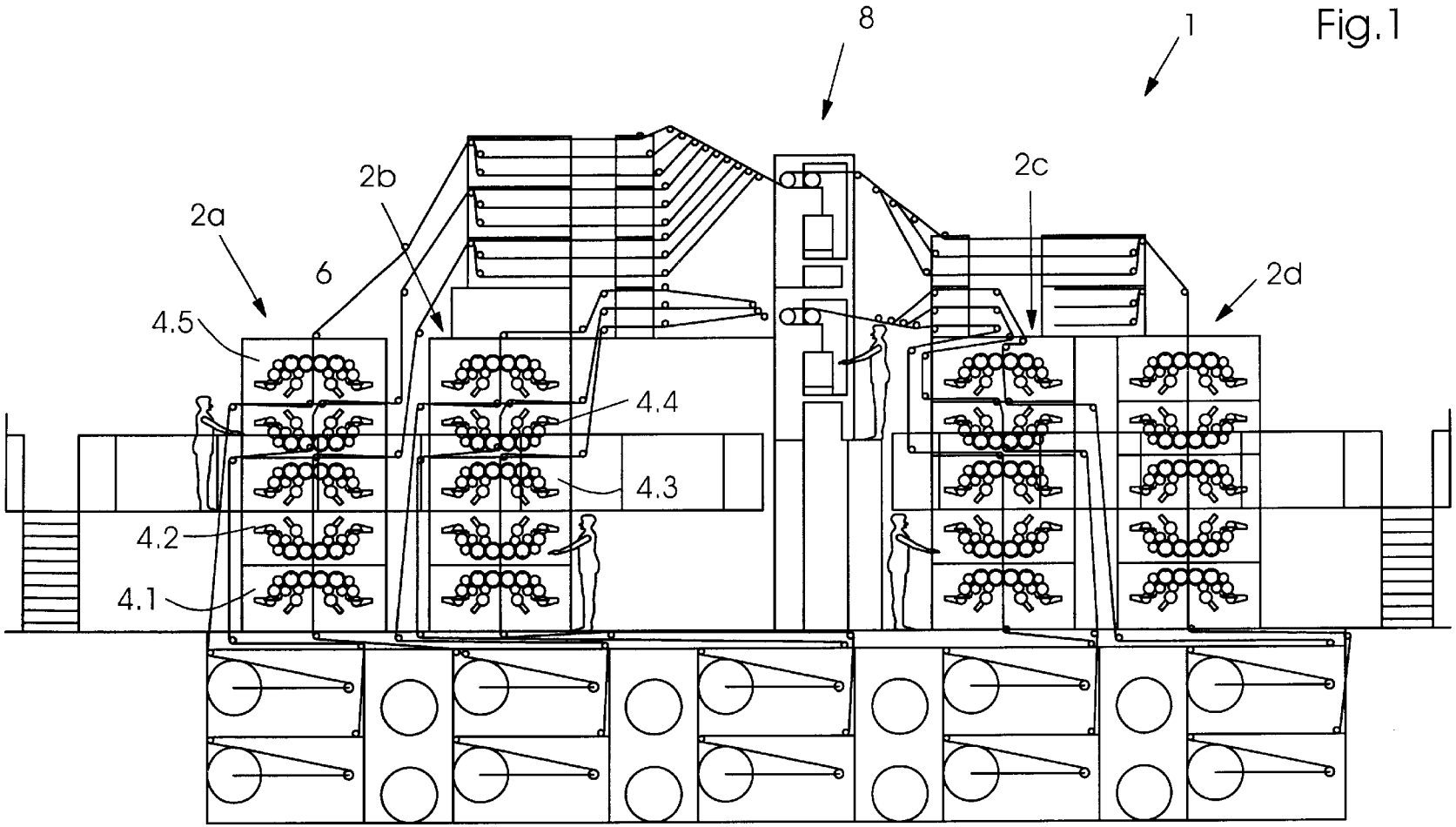
FIG. 1 is a schematic side view of a preferred embodiment of a newspaper printing press according to the present invention, having two four-unit tower arrangements on either side of a folding apparatus.

A lithographic newspaper printing press 1 according to the present invention, which is schematically shown in FIG. 1, comprises a plurality of printing-unit tower arrangements 2*a*, 2*b*, 2*c* and 2*d*, each consisting of a plurality of printing units 4, e.g. four printing units 4, each printing one of the colors yellow, magenta, cyan and black on a first and a second side of a respective web 6 preferably running vertically through each of the units 4. The printing press 1 according to the present invention further comprises a folding apparatus 8, to which the plurality of webs 6 is supplied. The folding apparatus 8 is preferably located in the middle of the printing press 1 and provides a plurality of not shown cut and folded newspaper pages from the plurality of webs 6 for further processing. The present invention is not limited to the arrangement of towers 2, the number of printing units 4 arranged in each tower and the location of the folding apparatus 8 shown in FIG. 1. For example, it is also possible to arrange a further fifth printing unit 4 on top of one, two or more of the towers 2 and to place the folding apparatus 8 at the end of a row of towers 2.

Figure 2:
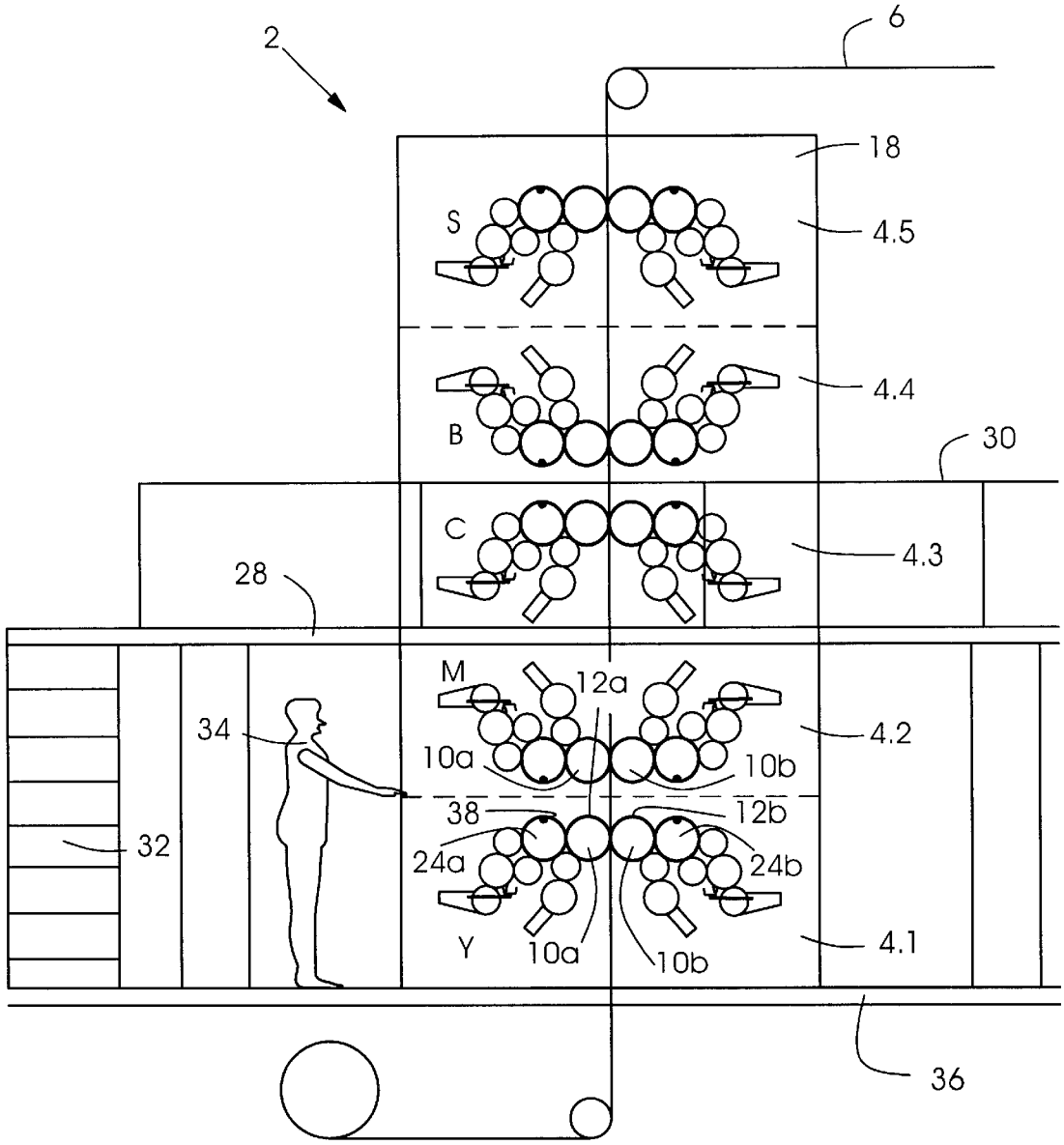
FIG. 2 is a schematic side view of a five-unit tower arrangement of another embodiment of a printing press according to the present invention.

A schematic cross-sectional view of a preferred tower arrangement 2 with altogether five printing units 4.1, 4.2, 4.3, 4.4 and 4.5 mounted on top of each other is shown in detail in FIG. 2. Each printing unit 4 comprises a first and a second blanket cylinder 10*a*, 10*b*, on which a respective first and second continuous, sleeve-shaped printing blanket 12*a*, 12*b* is mounted. As shown in detail in FIG. 3, the continuous printing blankets 12*a*, 12*b* are mounted on the blanket cylinders 10*a*, 10*b* such, that they are axially removable from the first and second blanket cylinders 10*a*, 10*b* through respective apertures 14 formed in one first side wall 16 of the housing 18 of the printing press 1. When removing the first and/or the second blanket sleeve 12*a*, 12*b* it through respective apertures 14, the first and/or second blanket cylinders 10*a*, 10*b* are cantilevered in a second side wall 20 of the housing 18, as it is e.g. indicated in FIG. 3. During the operation of the printing press, the first and second blanket cylinders 10*a*, 10*b* are preferably rotatably supported in both side walls 16 and 20 of the housing 18, as it is shown in FIG. 4. Therefore, a respective bearing 22 is mounted in the aperture 14 associated with each of the blanket cylinders 10*a*, 10*b*, as it is indicated in FIG. 4. A detailed description of the mounting of continuous sleeve-shaped printing blankets on cantilevered blanket cylinders is e.g. described in detail in U.S. Pat. No. 5,429,048, which is hereby incorporated by reference.

Each printing unit 4 further comprises a first and second plate cylinder 24*a*, 24*b* associated with said first and second blanket cylinders 10*a*, 10*b*. Each of the first and second plate cylinders 24*a*, 24*b* has substantially the same diameter as its associated blanket cylinder 10*a*, 10*b* and carries a set of four printing plates A, B, C, D and E, F, G, H, whereby each printing plate A, B, C, D, E, F, G, H is carrying the image of a respective newspaper page to be printed on the web 6.

The printing plates A, B, C, D, E, F, G, H are preferably conventional flexible, flat printing plates which are wrapped around the body of the first and/or second plate cylinder 24*a*, 24*b* and which are held on said cylinders 24 by means of a known plate lock-up device 38, which is schematically shown in FIG. 2.

In a preferred embodiment of the invention, each of the first and second plate cylinders 24*a*, 24*b* comprises a plate lock-up mechanism 38 for separately locking up each of the four conventional printing plates A, B, C, D, E, F, G, H. A plate lock-up mechanism for separately locking up four different printing plates is e.g. described in U.S. Pat. No. 3,335,663 and U.S. Pat. No. 3,230,897, which are hereby incorporated by reference.

Figure 5:
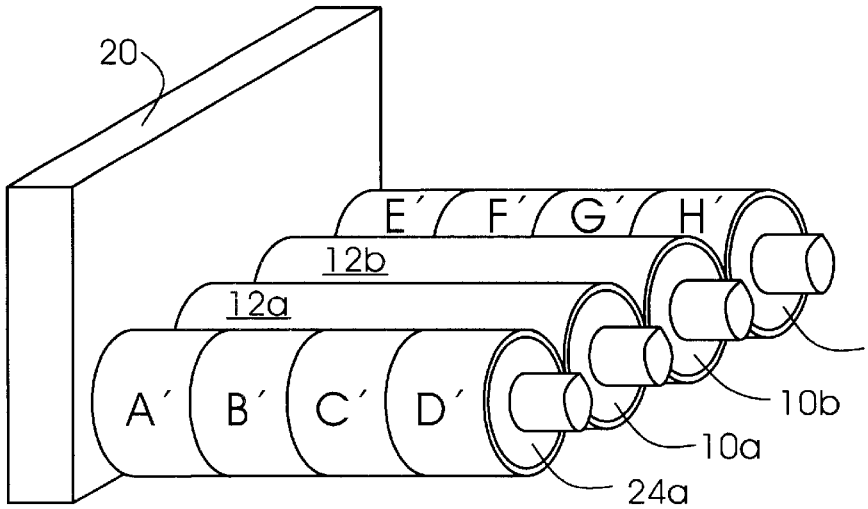
FIG. 5 shows a further embodiment of the present invention, in which the printing plates are formed as continuous sleeve-shaped printing plates mounted on a cantilevered plate cylinder side by side.

Alternatively, the printing plates A, B, C, D, E, F, G, H can also be formed as continuous sleeve-shaped printing plates A', B', C', D', E', F', G', H', as e.g. known from U.S. Pat. No. 4,913,048 which is hereby incorporated by reference. In this embodiment of the invention, which is schematically shown in FIG. 5, the first and second plate cylinders 24*a*, 24*b* are cantilevered in the respective side wall 20 of the housing 18 when axially removing the continuous plate sleeve A', B', C' and D' through a not shown aperture formed in the opposite side wall of the housing 18 when the printing press is not in operation. During the operation of the printing press 1, the plate cylinders 24*a*, 24*b* of this embodiment of the invention are preferably also rotatably supported in both side walls 16, 20 of the housing 18, as it is hereinbefore described for the associated blanket cylinders 10*a* and 10*b*.

In the preferred embodiment of the invention, the printing plates A, A', B, B', C, C', D, D' and E, E', F, F', G, G', H, H and D, D' are preferably mounted on the respective first and second plate cylinder 24*a*, 24*b* such, that there is no gap or space provided between two neighboring printing plates. Alternatively, according to a not shown embodiment of the invention, the conventional flexible, flat printing plates or the continuous sleeve-shaped printing plates can be mounted on the respective plate cylinders 24*a*, 24*b* such, that there is provided a defined distance between the side edges of two neighboring printing plates.

As it can be seen from FIG. 1 and FIG. 2, in the preferred embodiment of the invention the first and second plate cylinders 24*a*, 24*b* of each printing unit are preferably arranged substantially in line, whereby it can be advantageous, that the cylinders of each printing unit are slightly inclined with respect to the horizontal, in order to increase the wrap of the web 6 around each of the first and second blanket cylinders 10*a*, 10*b* of the printing units 4.

Figure 3:
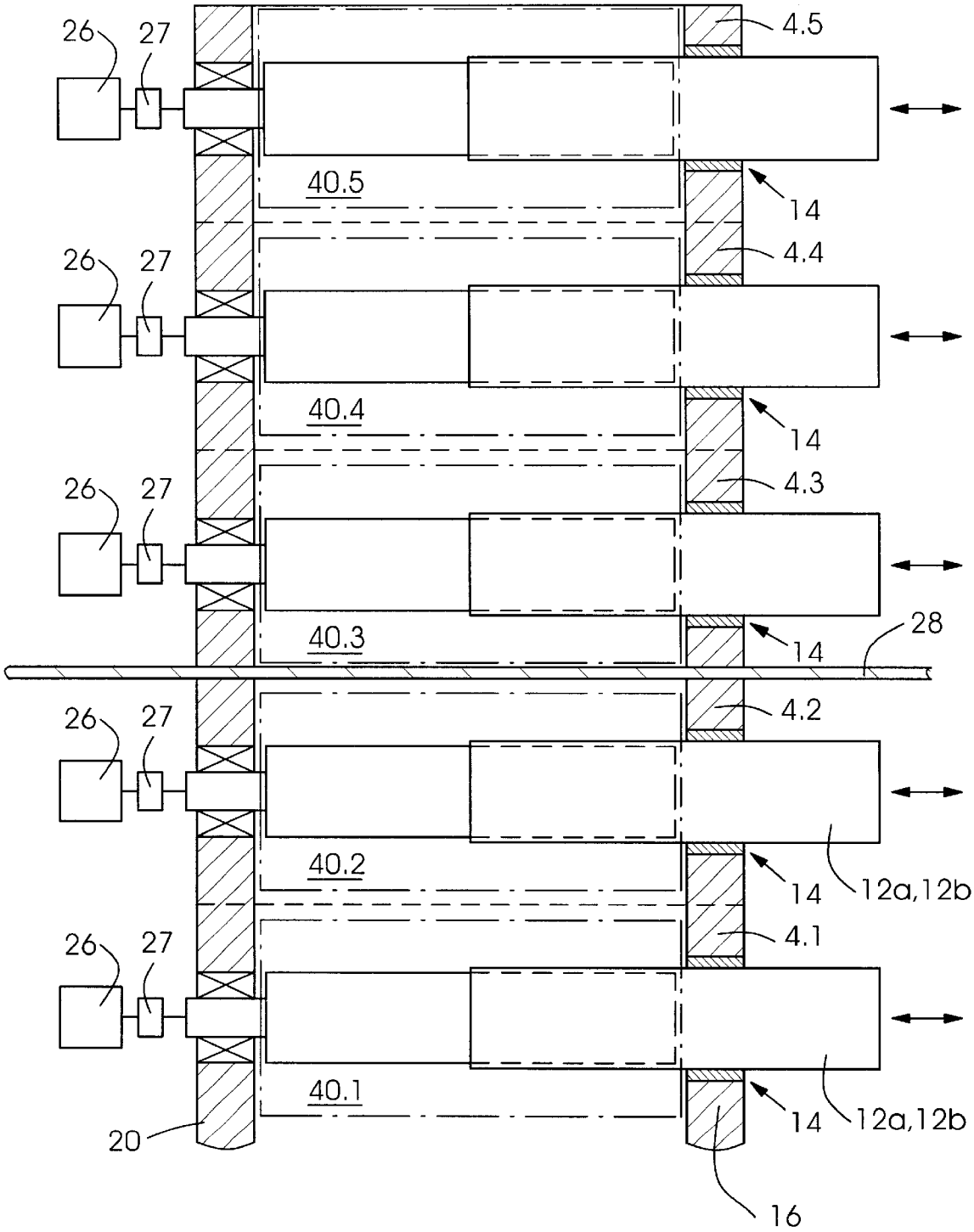
FIG. 3 is a schematic front view of the five-unit tower arrangement of FIG. 2.
Figure 4:
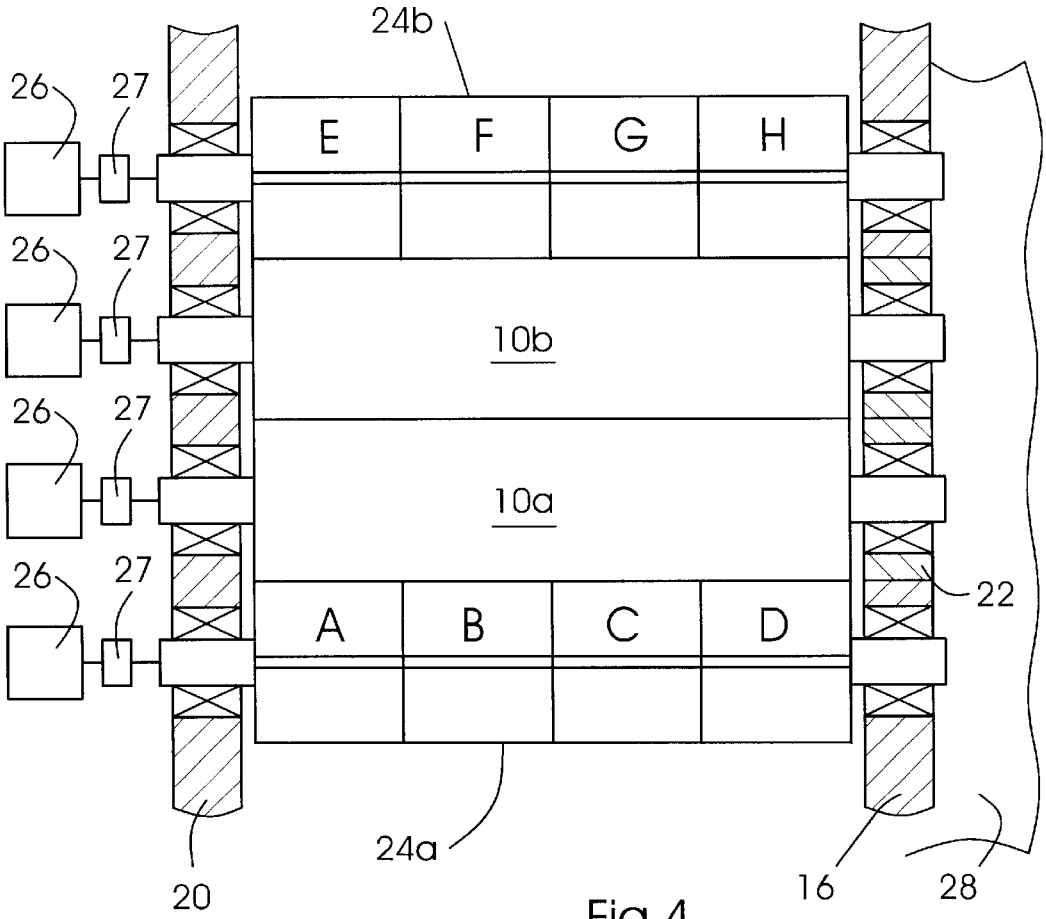
FIG. 4 is a schematic top view of a printing unit of a lithographic newspaper printing press according to the present invention.

As it can further be seen from FIG. 2 and FIG. 3, in the preferred embodiment of the invention, each of the printing couples formed of the first and second plate cylinders 24*a*, 24*b* and its associated blanket cylinders 12*a*, 12*b* is driven by a separate motor 26. In this embodiment the circumferential register adjustment is performed via the separate motors 26. Alternatively, the plate and blanket cylinders 24*a*, 24*b* and 10*a*, 10*b* can also be driven by a common drive shaft. In order to provide for a circumferential register adjustment of the first and second plate cylinders 24*a*, 24*b*, there can be provided a respective circumferential adjustment apparatus 27, e.g. in form of a known harmonic drive coupled to the drive shaft of each of the first and/or second plate cylinder 24*a*, 24*b*. The circumferential and, additionally, the lateral register adjustment of each of the plate cylinders 24*a*, 24*b* can also be performed by means of a known conventional adjustment apparatus, as it is e.g. described in U.S. Pat. No. 5,535,675 which is hereinafter incorporated by reference.

In a preferred embodiment of the invention the first and second plate cylinders 24*a*, 24*b* comprise a length which lies in the range between 1200 mm and 1700 mm. In this embodiment of the invention, the circumference of the first and second plate cylinders 24*a*, 24*b* and the first and second blanket cylinders 10*a*, 10*b* is preferably in the range between 470 mm and 650 mm. In this embodiment of the invention, the length to diameter ratio of said first and second plate cylinders 24*a*, 24*b* is accordingly in the range between 8.4:1 and 9:1.

As described hereinbefore and as it is shown, for example, in FIG. 1, there can be four printing units 4 arranged on top of each other, each printing unit printing one of the colors; yellow (Y), magenta (M), cyan (C) and black (B), whereby the web is running substantially vertical from one unit 4 to the other. In an even more preferred embodiment of the invention, there are arranged four printing units 4.1, 4.2, 4.3 and 4.4 for printing the colors yellow (Y), magenta (M), cyan (C) and black (1), together with a fifth printing unit 4.5, on top of each other, as it is shown in FIG. 2. The fifth printing unit 4.5 can either be used for printing an additional pure color (S) which can only be printed in low quality by combining the four colors yellow (Y), magenta (M), cyan (C) and black (B) and which is e.g. used for company logos etc.

Alternatively, the fifth printing unit 4.5 can also be used for printing the same color, preferably black (B), in alternation with one of the lower printing units 4.1 to 4.4 printing the same color. In this mode of operation, the printing unit which is currently not used for a print job is set silent after disengaging the respective plate cylinders 10*a*, 10*b* of the unit 4 from the running web 6. The silent printing unit 4 can then be equipped with new printing blankets 12*a*, 12*b* or with new printing plates A, A', B, B', C', D, D', E, E', F, F', G, G' and H, H for the next print job.

As it is shown in FIG. 2, there can further be provided a gallery or working platform 28 with a scaffolding 30 and a ladder 32 for entering the platform 28. The platform 28 has preferably a height of about 2.2 m and is located between the printing units 4.2 and 4.3 shown in FIG. 2 such, that the lower printing units 4.1 and 4.2 can be set up by the press operator 34, while standing on the floor 36 of the press room, and the upper three printing units 4.3, 4.4 and 4.5 can be equipped or set up by the press operator 34 while standing on the platform 28. According to the embodiment of the printing unit 4.1 to 4.5 of the tower arrangement 2 shown in FIG. 2, the height of each printing unit 4.1, 4.2 is about 1.1 m and the height of the platform 28 is approximately 2.2 m. Thus, the press operator 34 can easily axially remove the continuous printing blankets 12*a*, 12*b* and/or continuous printing plates A', 13', C', D' and E', F', G', H' of FIG. 5 of the upper printing units 4.3 to 4.5 through the respective aperture 14 shown in FIG. 4, while standing on the platform 28.

In the preferred embodiment of the invention using conventional printing plates A, B, C, D and E', F', G', H' on the respective first and second plate cylinder 24*a*, 24*b*, the flat, flexible plates are preferably replaced through apertures 40.1, 40.2, 40.3, 40.4, 40.5, as indicated in FIG. 3.

It is understood that the height of each printing unit 4 or the height of the platform 28 can also be larger or smaller.

What is claimed is:

1. A lithographic newspaper printing press with at least one printing unit, the printing press printing a newspaper page, the printing unit comprising:

a housing having a first side wall and a second side wall;

a first and a second plate cylinder each being rotatably mounted in the housing, the plate cylinders having a length being substantially four times the width of the newspaper page and having a circumference being substantially equal to the height of the newspaper page, wherein each of the first and second plate cylinders carries four flexible printing plates, the flexible printing plates being wrapped around the cylinders and being held by a plate lock-up mechanism, and wherein the flexible printing plates are mounted on the first and second plate cylinders side by side;

a first and a second blanket cylinder associated with the first and second plate cylinders, each of the first and second blanket cylinders having substantially the same diameter as the associated plate cylinder;

an axially removable continuous blanket sleeve mounted on each of the first and second blanket cylinders, each of the first and second blanket cylinders being cantilevered in the first side wall of the housing, when removing the continuous blanket sleeves from the first and second blanket cylinders;

wherein the length to diameter ratio of the first and second plate cylinders is in the range between 8.4:1 and 9:1.

2. The printing press according to claim 1, wherein the first and second plate cylinders and the associated blanket cylinders of each printing unit are arranged substantially in line.

3. The printing press according to claim 1, wherein the plate cylinders and their associated blanket cylinders form printing couples, and each of the printing couples is driven by a separate motor.

4. The printinq press according to claim 3, wherein each of the plate cylinders has a circumferential register adjustment system.

5. The printing press according to claim 1, wherein the length of the first and second plate cylinders is in the range between 1200 mm and 1700 mm.

6. The printing press according to claim 1, wherein the circumference of each of the first and second plate cylinders is in the range between 470 mm and 650 mm.

7. The printing press according to claim 1, wherein four printing units, each printing unit printing a different color, are arranged on top of each other, and wherein a web runs substantially vertically from one unit to the other.

8. The printing press according to claim 7, wherein a fifth printing unit is arranged on top of the four printing units.

9. The printing press according to claim 8, wherein each of the printing units has a mechanism for disengaging the plate cylinders, and wherein the fifth printing unit prints the same color as one of the four printing units and is operated alternately with the printing unit printing the same color.

10. The printing press according to claim 7, wherein the four printing units are for printing the colors yellow, magenta, cyan and black and the fifth printing unit is printing spot-colors which are different from the colors of the four printing units.

11. The printing press according to claim 1, wherein each of the plate cylinders includes a plate lock-up mechanism for separately locking up four flat printing plates.

12. The-printinq press according to claim 1, wherein a pinless folding apparatus for processing a printed web into signatures is provided downstream of the printing unit, the web printed in the printing units being fed to the pinless folding apparatus.

13. A lithographic newspaper printing press with at least one printing unit, the printing press printing a newspaper page, the printing unit comprising:

a housing having a first side wall and a second side wall;

a first and a second plate cylinder each being rotatably mounted in the housing, the plate cylinders having a length being substantially four times the width of the newspaper page and having a circumference being substantially equal to the height of the newspaper page, wherein each of the first and second plate cylinders carries four axially movable continuous printing plates, each of the first and second plate cylinders being cantilevered in the first side wall of the housing when at least one of the continuous printing plates is axially removed from the plate cylinders;

a first and a second blanket cylinder associated with the first and second plate cylinders, each of the first and second blanket cylinders having substantially the same diameter as the associated plate cylinder;

an axially removable continuous blanket sleeve mounted on each of the first and second blanket cylinders, each of the first and second blanket cylinders being cantilevered in the first side wall of the housing, when removing the continuous blanket sleeves from the first and second blanket cylinders.

14. The printing press according to claim 13, wherein the axially removable continuous printing plates are mounted on the first and second plate cylinders side by side.

* * * * *